US008834325B2

(12) United States Patent
Chen

(10) Patent No.: US 8,834,325 B2
(45) Date of Patent: Sep. 16, 2014

(54) BOXING TRAINING DEVICE

(76) Inventor: Tina Chen, Taichung (TW)

( * ) Notice: Subject to any disclaimer, the term of this patent is extended or adjusted under 35 U.S.C. 154(b) by 284 days.

(21) Appl. No.: 13/548,052

(22) Filed: Jul. 12, 2012

(65) Prior Publication Data

US 2014/0018212 A1 Jan. 16, 2014

(51) Int. Cl.
*A63B 21/00* (2006.01)

(52) U.S. Cl.
USPC ..... 482/87

(58) Field of Classification Search
USPC ..... 482/83, 84, 85, 86, 87, 88, 89, 90
See application file for complete search history.

(56) References Cited

U.S. PATENT DOCUMENTS

2008/0254950 A1* 10/2008 Beliles ..... 482/83
2009/0098985 A1* 4/2009 Gonzalez ..... 482/83
2009/0264262 A1* 10/2009 Brenner et al. ..... 482/83

* cited by examiner

*Primary Examiner* — Jerome W Donnelly

(57) ABSTRACT

A boxing training device including a main body and at least one boxing assembly is provided. The boxing assembly is mounted to an upper portion of a main body via a shell body. The shell body defines a receiving space, one end of a rod is disposed in the receiving space, and the rod is pivoted to the shell body via a pivoting portion. Two resilient members are disposed at two sides by the pivoting portion and resiliently engaged against between the rod and the shell body. Whereby, the boxing training device is easy to control so as to prevent users from being injured, simple in structure, and easy to assemble and convenient to store.

8 Claims, 4 Drawing Sheets

BOXING TRAINING DEVICE

BACKGROUND OF THE INVENTION

1. Field of the Invention

The present invention relates to a boxing training device.

2. Description of the Prior Art

A conventional boxing training device is as disclosed in TW 1353263. In TWI353263, the boxing training device is composed of many components and very complicated in structure, such that it is time-consuming to fabricate the device, the production cost is increased, and it is uneasy to assemble and inconvenient to store.

Additionally, since there is no position-limiting mechanism disposed between every arm portion and every joint adapted for fixing the arm portion, it can result in an unexpected over swing of the arm portion to cause damage to user if an unsuitable great force is exerted on the arm portion.

The present invention is, therefore, arisen to obviate or at least mitigate the above mentioned disadvantages.

SUMMARY OF THE INVENTION

The main object of the present invention is to provide a boxing training device which is easy to control so as to prevent users from being injured, simple in structure, easy to assemble and convenient to store, and helps the increase of the yield and the decrease of the production cost.

To achieve the above and other objects, a boxing training device of the present invention includes a main body and at least one boxing assembly.

The main body includes an upper portion. The at least one boxing assembly includes a shell body, a pivoting portion, a rod and two resilient members. The boxing assembly is mounted to the upper portion of the main body via the shell body. The shell body defines a receiving space and includes an opening. One end of the rod is disposed in the receiving space through the opening and pivoted to the shell body via the pivoting portion. The two resilient members are located at two radial sides of the pivoting portion respectively, and the two resilient members resiliently engaged against and between the rod and an inner sidewall of the shell body.

The rod is pivotally connected to the shell body via the pivoting portion and located in the receiving space, which serves as a limiting mechanism, such that it cannot result in an unexpected over swing of the rod to cause damage to user, and the boxing assembly is easy to assemble and convenient to store.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
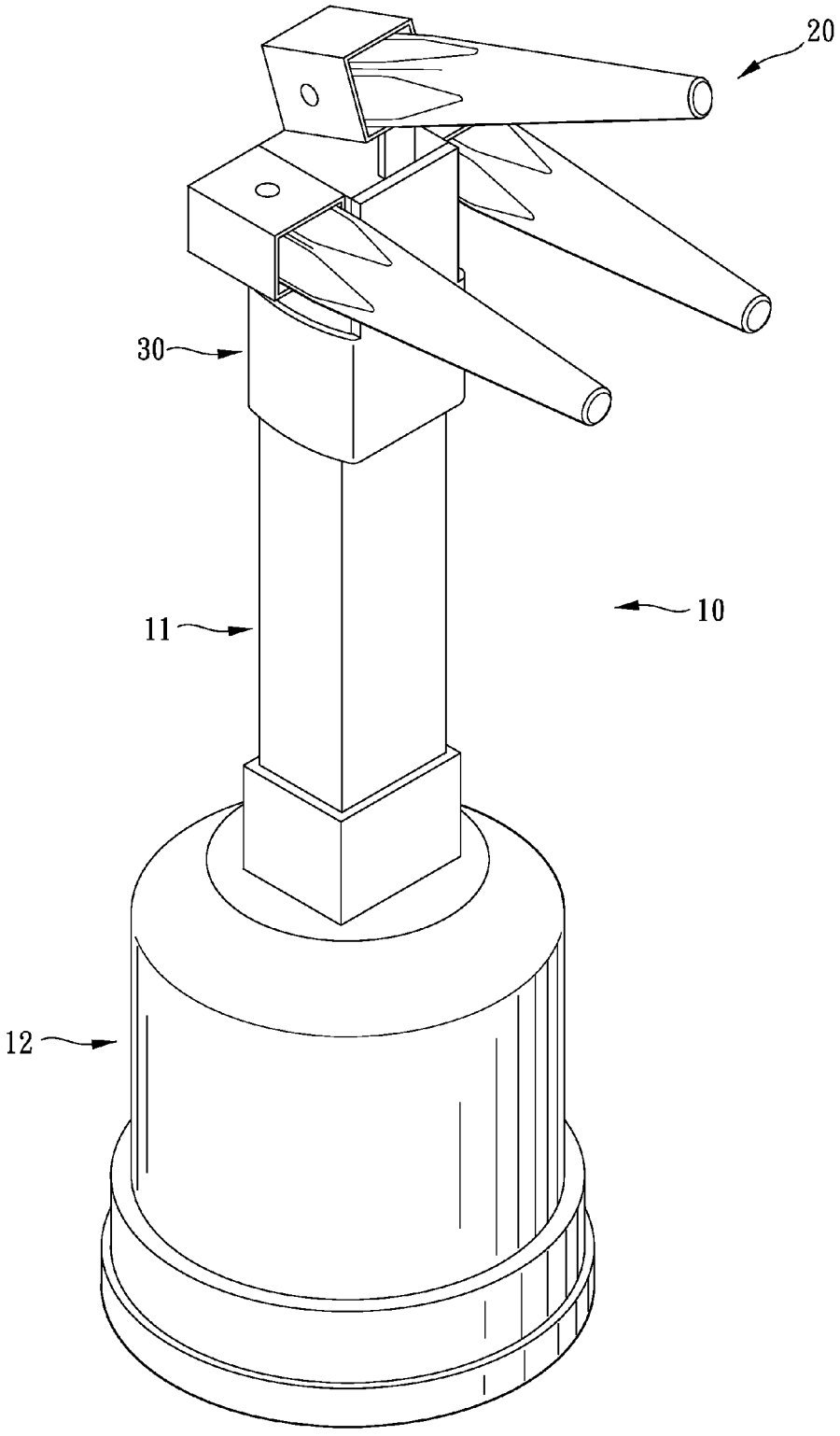
FIG. 1 is perspective view of a boxing training device of the present invention.
Figure 2:
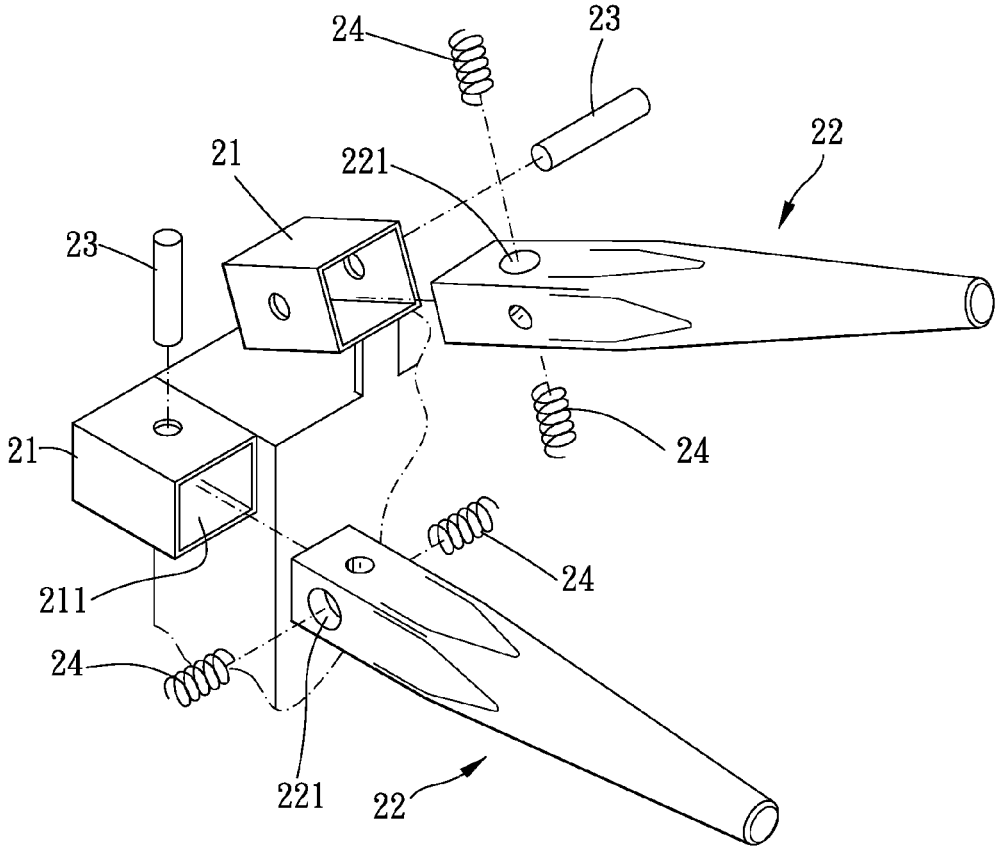
FIG. 2 is a partial breakdown drawing of the present invention.

As shown in FIGS. 1 and 2, a boxing training device of the present includes a main body 10 and three boxing assemblies 20.

The main body 10 includes an upper portion and a lower portion, the upper portion has a substantially polygonal post 11, and the lower portion has a supporting base 12. More specifically, the post 11 is a tetragonal rod, the post 11 includes an upper surface and a plurality of side surfaces, and the supporting base 12 is a substantially cylindrical rod. The post 11 vertically fixedly disposed on the supporting base 12. Preferably, the area of a radial cross-section of the supporting base 12 is greater than that of the post 11, and the supporting base 12 is heavier than the post 11, such that the boxing training device can stand stably. In other embodiment, the post 11 may be detachably mounted to the supporting base 12, and thus it is to assemble, disassemble and store. Besides, the post 11 may be retractable and adapted for adjusting the positions of the respective boxing assemblies 20.

Each the boxing assembly 20 includes a shell body 21, a rod 22, a pivoting portion 23 and two resilient members 24.

In this embodiment, one of the boxing assemblies 20 is mounted to the upper surface of the post 11 and slightly slants upwardly, and the others of the boxing assemblies 20 are mounted to the corresponding left and right side surfaces of the post 11. The openings of the shell bodies 21 of the boxing assemblies 20 face substantially in the same direction (for example, face substantially frontward), such that the user can practice boxing with the boxing training device which can serve as a supposed competition, just like boxing in a real boxing competition, and the effect of practice is improved.

It is should be noted that in this embodiment, the boxing training device includes three boxing assemblies 20, and the boxing assemblies 20 are mounted to the upper, left and right side surfaces of the post 11 respectively. However, in other embodiment, the boxing training device may be mounted with one boxing assembly 20, and the boxing assembly 20 may be mounted to one of the upper surface and the side surfaces of the post 11. The boxing training device may be mounted with two or more than three of the boxing assemblies 20, and each of the boxing assemblies 20 may be mounted to any suitable position of the post 11 according to various requirements of user.

Each of the boxing assemblies 20 is fixedly or adjustably mounted to the post 11 via the shell body 21, and each of the shell bodies 21 defines a receiving space 211 and includes an opening.

Each rod 22 is pivoted to each shell body 21 respectively. More specifically, each rod 22 is disposed in the receiving space 211 through the opening of the shell body 21 and pivoted to each shell body 21 with each pivoting portion 23.

Either of two corresponding side surfaces of the rod 22 is formed with a round hole 221, and the shapes of the corresponding hole 221 and resilient member 24 may be, but not limited to, substantially complementary. The two holes 221 are formed substantially along the same axis which is substantially perpendicular to the axial direction of the pivoting portion 23. The holes 221 of the boxing assembly 20 mounted to the upper surface of the post 11 are formed substantially along a vertical (up-down) axis, and the holes 221 of the boxing assemblies 20 mounted to the left and right side surfaces of the post 11 are formed substantially along a lateral (left-right) axis, respectively.

Each pivoting portion 23 is adapted for connecting the shell body 21 and the rod 22 of each boxing assembly 20, the axial direction of each pivoting portion 23 is substantially perpendicular to the axis along which the holes 221 of the boxing assembly 20 are formed. In this embodiment, the pivoting portion 23 is formed as a pin penetrating through the shell body 21 and rod 22, such that the user can assemble the boxing assembly 20 quickly. However, in other embodiment, the shell body 21 and the rod 22 can be assembled in other manner. For example, two projections (equivalent to the pivoting portion 23) may protrude respectively from corresponding two inner sidewalls of the shell body 21 toward the receiving space 211, and two pivoting holes corresponding to the projections are formed on the rod 22 for the two respective projections fitting into; two projections (equivalent to the pivoting portion 23) may protrude outwardly from corresponding two side surfaces at one end of the rod 22 respectively, and two pivoting holes corresponding to the projections corresponding to the projections are formed at two sides of the shell body 21 for the two respective projections fitting into, such that the shell body 21 and the rod 22 are pivotally connected.

Figure 3A:
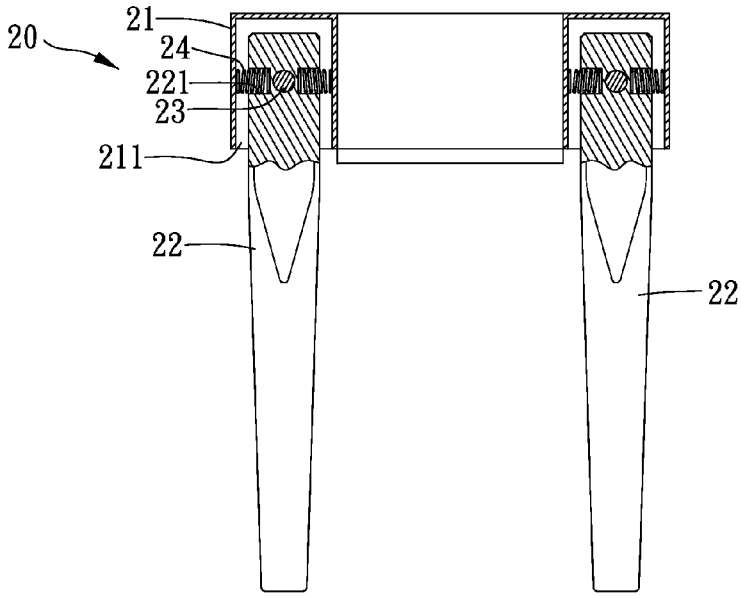
FIG. 3A is a top view showing a part of the boxing training device of the present invention.
Figure 3B:
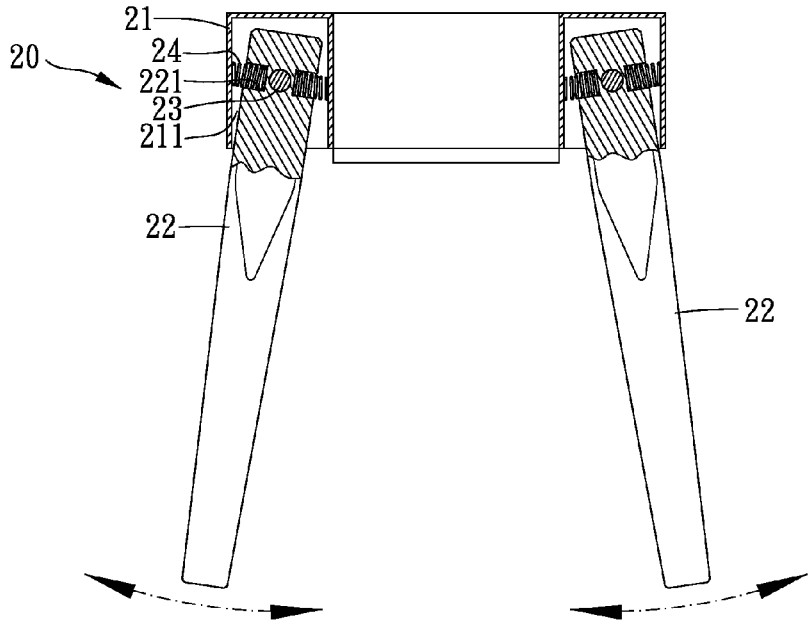
FIG. 3B is a drawing showing the boxing training device in use according to the present invention.

The boxing assemblies 20 mounted to the left and right sides of the post 11 are representatively described herein. As shown in FIGS. 3A and 3B, the two resilient members 24 of each boxing assembly 20 are located at two radial sides of the pivoting portion 23 respectively. More specifically, one end of each resilient member 24 is disposed in each hole 221, and the other end of each resilient member 24 is resiliently engaged against the inner sidewall of the shell body 21. When an external force is exerted on the rod 22, the rod 22 can swing between a first position and a second position around the pivoting portion 23.

Whereby, by utilizing the spring force of the two resilient members 24, the rod 22 tends to revert to be original state (as shown 3A) and swings between the first position and the second position around the pivoting portion 23 after an external force is exerted on the rod 22. Compared to a conventional structure, in the invention, the unexpected over swing of the rod 22 due to an unsuitable great external force is avoided, and it cannot cause damage to user and is safe.

Additionally, since the corresponding two side surfaces of one end of each rod 22 are formed with the round holes 221 for receiving one end of each of the resilient members 24 respectively, the resilient members 24 can be stably restrained, and the departure issue of the resilient members 24 can be prevented when the rod 22 swings.

Figure 4:
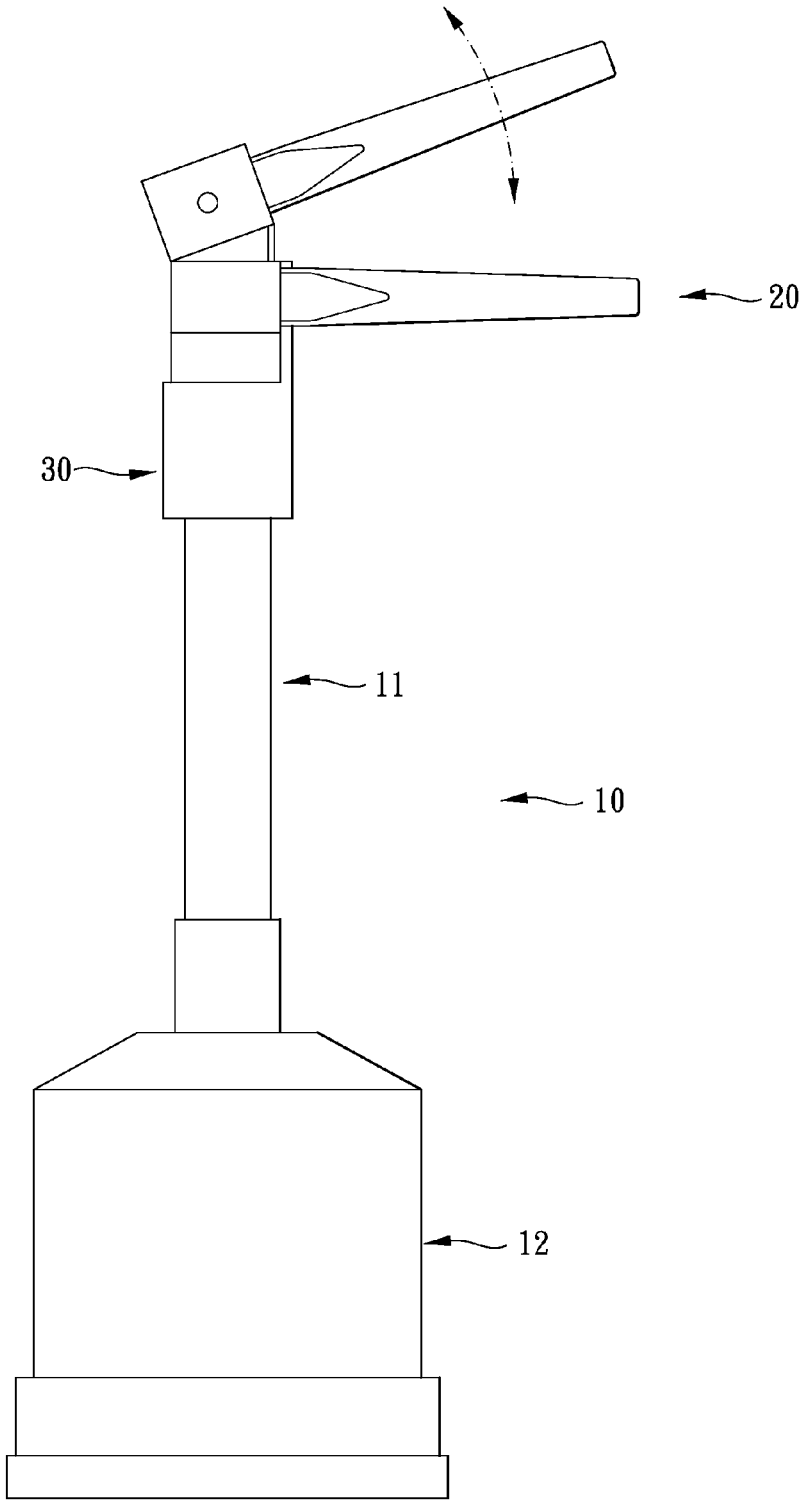
FIG. 4 is a side view of the boxing training device of the present invention present invention.

It is noted that, as shown in FIGS. 3B and 4, the swinging direction of the rod 22 of the boxing assembly 20 mounted to the upper surface of the post 11 are different from that of the boxing assemblies 20 mounted to the left and right side surfaces of the post 11. More specifically, the rod 22 of the boxing assembly 20 mounted to the upper surface of the post 11 swings up and down substantially along the longitudinal direction of the main body 10. The boxing assemblies 20 mounted to the left and right side surfaces of the post 11 swing left and right substantially along the lateral direction of the main body 10. Hence, the user can practice boxing with the boxing training device which can serve as a supposed competition, just like boxing in a real boxing competition, and the effect of practice is improved.

Furthermore, as shown FIG. 1, the structural arrangement of the invention may be changed. For example, the boxing assemblies 20 may be detachably mounted to the post 11 via a sleeve 30. More specifically, the interior shape of the sleeve 30 preferably corresponds to the shape of one end of the post 11, such that the boxing assemblies 20 can be mounted to the upper, left and right side surfaces of the post 11 respectively, and the sleeve 30 is then fixedly mounted to the post 10. Since the sleeve 30 can be detachably mounted, the boxing assemblies 20 are easy to assemble and convenient to store, and the boxing training device is small in size.

In addition, each shell body 21 may be adjustably mounted to the post 11, and the boxing assemblies 20 can be therefore adjusted according to different user requiring position, such that the user can practice boxing with the boxing training device to simulate the offence and defense of a supposed competition, and the effect of practice is improved.

Moreover, in the invention, the shell body 21 and the rod 22 are pivotally connected to each other via the pivoting portion 23, so that the boxing training device is simple in structure and easy to assemble, the yield can be increased, and the production cost can be decreased.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A boxing training device, including:

a main body, including an upper portion; and at least one boxing assembly, including a shell body, a pivoting portion, a rod and two resilient members, the boxing assembly mounted to the upper portion of the main body via the shell body, the shell body defining a receiving space and including an opening, one end of the rod being disposed in the receiving space through the opening and pivoted to the shell body via the pivoting portion, the two resilient members being located at two radial sides of the pivoting portion respectively, and the two resilient members resiliently engaged against and between the rod and an inner sidewall of the shell body.

2. The boxing training device of claim 1, wherein either of two corresponding side surfaces of the rod is formed with a hole, one end of each resilient member is disposed in the hole and the other end of each resilient member is resiliently engaged against the inner sidewall of the shell body.

3. The boxing training device of claim 2, wherein each hole is formed substantially along an axis, and the axial direction of the pivoting portion is substantially perpendicular to the axis.

4. The boxing training device of claim 1, wherein the boxing assembly is mounted to the upper surface of the upper portion.

5. The boxing training device of claim 1, wherein the upper portion is formed with a post which is substantially polygonal, the post includes an upper surface and a plurality of side surfaces, and the boxing assembly is mounted to one of the side surfaces of the post.

6. The boxing training device of claim 1, wherein the main body further includes a lower portion, and the lower portion is formed with a supporting base.

7. The boxing training device of claim 1, wherein the pivoting portion is a pin penetrating the shell body and the rod.

8. The boxing training device of claim 1, wherein the boxing training device includes three boxing assemblies, one of the boxing assembly is mounted to an upper surface of the main body, the other two boxing assemblies are mounted to two corresponding side surfaces of the main body respectively, and the openings of the shell bodies of the boxing assemblies face substantially in the same direction.

* * * * *